US011514881B2

(12) United States Patent
Kim

(10) Patent No.: US 11,514,881 B2
(45) Date of Patent: Nov. 29, 2022

(54) VEHICLE AND METHOD OF CONTROLLING THE SAME

(71) Applicants: Hyundai Motor Company, Seoul (KR); Kia Corporation, Seoul (KR)

(72) Inventor: Youngbeom Kim, Gyeonggi-do (KR)

(73) Assignees: Hyundai Motor Company, Seoul (KR); Kia Corporation, Seoul (KR)

( * ) Notice: Subject to any disclaimer, the term of this patent is extended or adjusted under 35 U.S.C. 154(b) by 0 days.

(21) Appl. No.: 17/523,575

(22) Filed: Nov. 10, 2021

(65) Prior Publication Data

US 2022/0254326 A1 Aug. 11, 2022

(30) Foreign Application Priority Data

Feb. 10, 2021 (KR) ..... 10-2021-0018984

(51) Int. Cl.

| | |
|---|---|
| ***G10K 11/175*** | (2006.01) |
| ***H04R 3/00*** | (2006.01) |
| ***G10K 11/162*** | (2006.01) |
| ***H04R 1/22*** | (2006.01) |

(52) U.S. Cl.

CPC ..... *G10K 11/175* (2013.01); *G10K 11/162* (2013.01); *H04R 1/22* (2013.01); *H04R 3/00* (2013.01); *H04R 2499/13* (2013.01)

(58) Field of Classification Search

CPC .. G10K 11/175; G10K 11/162; G10K 11/178; G10K 2210/128; G10K 2210/1282; G10K 15/02; H04R 1/22; H04R 3/00; H04R 2499/13; B60Q 5/008; H04B 1/082

See application file for complete search history.

(56) References Cited

U.S. PATENT DOCUMENTS

2006/0269078 A1* 11/2006 Sakamoto ..... G10K 11/1783 381/71.1
2010/0266135 A1* 10/2010 Theobald ..... G10K 11/17857 381/71.4
2011/0175718 A1* 7/2011 Inoue ..... B60Q 5/008 340/463
2015/0269925 A1* 9/2015 Kanaya ..... G10K 11/1783 381/71.4
2017/0096099 A1* 4/2017 Matsubara ..... G10K 11/17855

* cited by examiner

*Primary Examiner* — Jason R Kurr
(74) *Attorney, Agent, or Firm* — Fox Rothschild LLP

(57) ABSTRACT

A vehicle for blocking a virtual engine sound that is introduced into the vehicle includes: a speed sensor configured to detect a travelling speed of the vehicle; a virtual engine sound system (VESS) including a first speaker and a second speaker; and a controller configured to control the VESS based on the travelling speed, wherein the controller is configured to: upon the vehicle being in a stopped state, control the VESS such that the first speaker outputs a virtual engine sound and the second speaker outputs a sound having an inverse phase of the virtual engine sound.

20 Claims, 7 Drawing Sheets

VEHICLE AND METHOD OF CONTROLLING THE SAME

CROSS-REFERENCE TO RELATED APPLICATION

This application claims under 35 U.S.C. § 119 the benefit of Korean Patent Application No. 10-2021-0018984, filed on Feb. 10, 2021 in the Korean Intellectual Property Office, the entire contents of which are incorporated herein by reference.

BACKGROUND

1. Technical Field

The disclosure relates to a vehicle for outputting a virtual engine sound and a method of controlling the same, more particularly, to the vehicle capable of blocking the virtual engine sound introduced into an inside of the vehicle.

2. Description of the Related Art

In general, plug-in vehicles are driven by a motor, and according to a low noise characteristic of the motor, generate almost no noise. Therefore, even when plug-in vehicles approach, very little noise is emitted, so pedestrians may not notice the plug-in vehicle approaching them, which may increase the risk of an accident.

Accordingly, plug-in vehicles have recently been equipped with a virtual engine sound system (VESS) that virtually outputs an engine sound so that a pedestrian may recognize an approach of a plug-in vehicle.

According to certain laws and regulations, plug-in vehicles, even while in a stopped state, need to output a virtual engine sound if a gear is placed in drive (i.e., the 'D' stage), but the virtual engine sound introduced into the plug-in vehicle may cause discomfort to occupants.

SUMMARY

The present disclosure provides a vehicle capable of reducing a virtual engine sound introduced into the vehicle that is in a stopped state, and a method of controlling the same.

Additional aspects of the disclosure will be set forth in part in the description which follows and, in part, will be obvious from the description, or may be learned by practice of the disclosure.

According to an aspect of the disclosure, there is provided a vehicle including: a speed sensor configured to detect a travelling speed of the vehicle; a virtual engine sound system (VESS) including a first speaker and a second speaker; and a controller configured to control the VESS based on the travelling speed, wherein the controller is configured to: upon the vehicle being in a stopped state, control the VESS such that the first speaker outputs a virtual engine sound and the second speaker outputs a sound having an inverse phase of the virtual engine sound.

The controller, upon the vehicle not being in a stopped state, may control the VESS such that the second speaker outputs a preset sound.

The preset sound may have a frequency band narrower than a frequency band of the virtual engine sound, and a sound pressure level greater than a sound pressure level of the virtual engine sound.

The preset sound may have a minimum frequency greater than a minimum frequency of the virtual engine sound.

The vehicle may include a sound blocker configured to be converted into a first state that blocks a front of the second speaker or a second state that opens the front of the second speaker, and an actuator configured to convert the sound blocker into one of the first state and the second state, wherein the controller may control the actuator to convert the sound blocker into the first state upon the vehicle being in a stopped state, and convert the sound blocker into the second state upon the vehicle not being in a stopped state.

The sound blocker may be provided to be rotatable through a hinge portion, and the actuator may include a driving motor configured to transmit a rotational force to the hinge portion.

The sound blocker may have a boundary that includes an elastic material.

The sound blocker may include a sound absorbing material disposed in a form of a wedge.

The first speaker and the second speaker may be installed on a same line with respect to at least two axes.

The first speaker and the second speaker may have a same size.

According to another aspect of the disclosure, there is provided a method of controlling a vehicle including a virtual engine sound system (VESS), the method including: outputting, by a first speaker of the VESS, a virtual engine sound upon a virtual engine sound output condition being satisfied; and outputting, by a second speaker of the VESS, a sound having an inverse phase of the virtual engine sound upon the vehicle being in a stopped state.

The method may further include outputting, by the second speaker, a preset sound upon the vehicle not being in a stopped state.

The preset sound may have a frequency band narrower than a frequency band of the virtual engine sound, and a sound pressure level greater than a sound pressure level of the virtual engine sound.

The preset sound may have a minimum frequency greater than a minimum frequency of the virtual engine sound.

The vehicle may include a sound blocker configured to be converted into a first state that blocks a front of the second speaker or a second state that opens the front of the second speaker, and the method may further include: converting the sound blocker into the first state upon the vehicle being in a stopped state, and converting the sound blocker into the second state upon the vehicle not being in a stopped state.

The sound blocker may be provided to be rotatable through a hinge portion, and wherein the converting of the sound blocker into the first state or the second state may include applying a driving current to a driving motor configured to transmit a rotational force to the hinge portion.

The sound blocker may have a boundary that includes an elastic material.

The sound blocker may include a sound absorbing material disposed in a form of a wedge.

The first speaker and the second speaker may be installed on a same line with respect to at least two axes.

The first speaker and the second speaker may have a same size.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
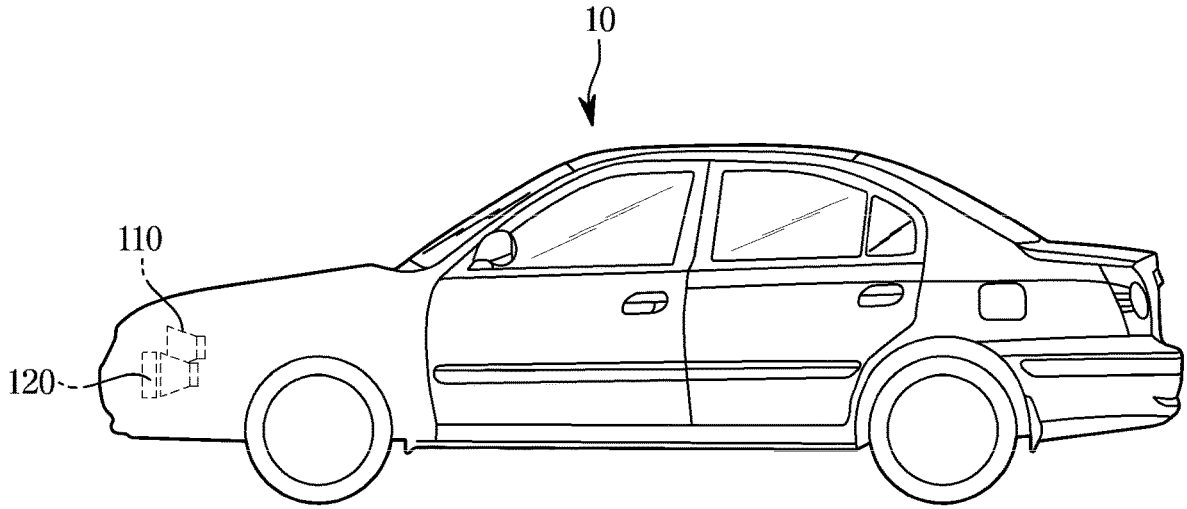
FIG. 1 is a diagram illustrating an external appearance of a vehicle according to an embodiment.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles. The terminology used herein is for the purpose of describing particular embodiments only and is not intended to be limiting of the disclosure.

As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof.

Further, the control logic of the present disclosure may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

Like numerals refer to like elements throughout the specification. Not all elements of embodiments of the present disclosure will be described, and description of what are commonly known in the art or what overlap each other in the embodiments will be omitted.

It will be further understood that the term "connect" or its derivatives refer both to direct and indirect connection, and the indirect connection includes a connection over a wireless communication network.

Further, when it is stated that a member is "on" another member, the member may be directly on the other member or a third member may be disposed therebetween.

Although the terms "first," "second," "A," "B," etc. may be used to describe various components, the terms do not limit the corresponding components, but are used only for the purpose of distinguishing one component from another component.

Reference numerals used for method steps are just used for convenience of explanation, but not to limit an order of the steps. Thus, unless the context clearly dictates otherwise, the written order may be practiced otherwise.

Hereinafter, the operating principles and embodiments of the disclosure will be described with reference to the accompanying drawings.

In the specification, the term "occupant" may refer to any person existing inside a vehicle, and may include a driver.

Hereinafter, an embodiment of a vehicle and a method of controlling the same according to an aspect will be described in detail with reference to the accompanying drawings.

Figure 2:
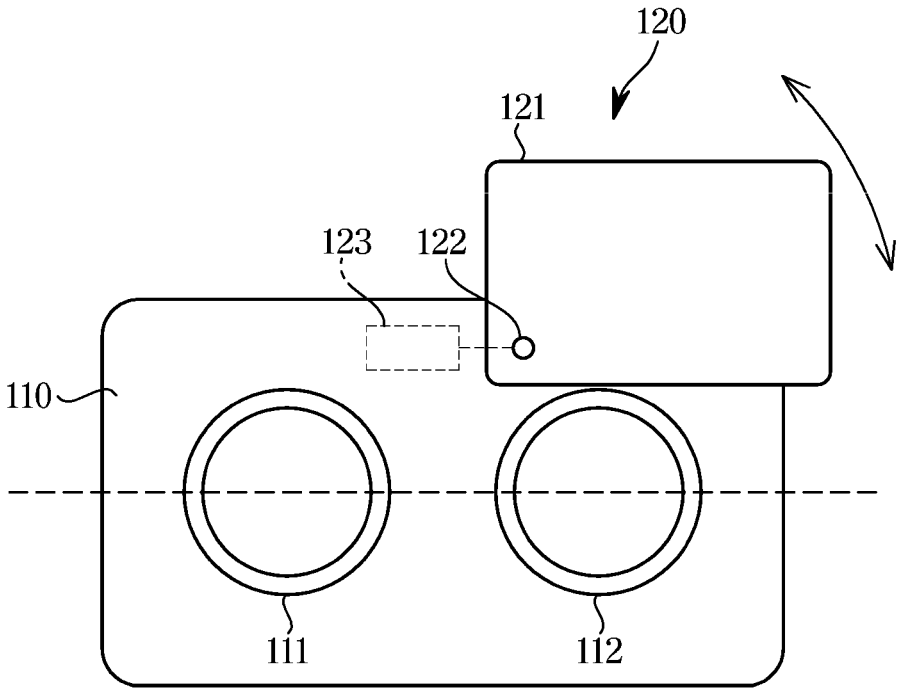
FIG. 2 is a diagram illustrating a virtual engine sound system (VESS) viewed from the front of a vehicle according to an embodiment.
Figure 3:
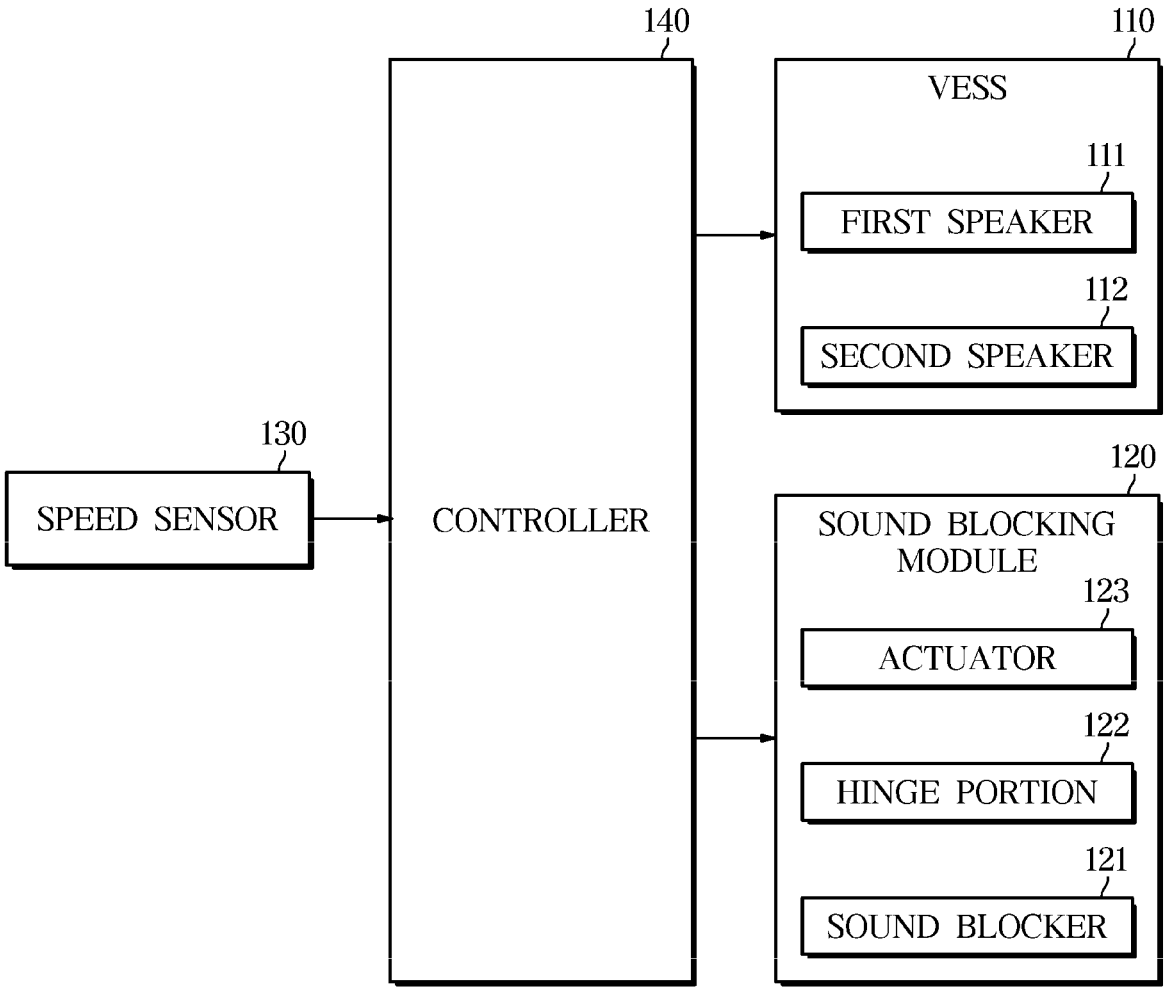
FIG. 3 is a control block diagram illustrating a vehicle according to an embodiment.

FIG. 1 is a diagram illustrating an external appearance of a vehicle according to an embodiment, FIG. 2 is a diagram illustrating a virtual engine sound system (VESS) viewed from the front of a vehicle according to an embodiment, and FIG. 3 is a control block diagram illustrating a vehicle according to an embodiment.

Referring to FIGS. 1 to 3, a vehicle 10 according to an embodiment includes a virtual engine sound system (VESS) 110 configured to output a virtual engine sound, a sound blocking module 120, a speed sensor 130, and a controller 140.

The vehicle 10 according to the embodiment may correspond to a plug-in vehicle that is equipped with a motor (not shown) driven by electricity and obtains power using the motor (not shown).

In this case, the plug-in vehicle may include a battery electric vehicle (BEV), a hybrid electric vehicle (HEV), a plug-in hybrid vehicle (Plug-in HEV), and the like, and may be variously provided as long as it can obtain power from a motor.

According to various embodiments, the VESS 110 may include at least two speakers (e.g., a first speaker 111 and a second speaker 112).

In one embodiment, when the VESS 110 is provided in front of a driver seat or a passenger seat (e.g., near a front bumper), the first speaker 111 and the second speaker 112 may output a sound in a forward direction of the vehicle 10.

In another embodiment, when the VESS 110 is provided behind the driver seat or the passenger seat (e.g., near a rear bumper), the first speaker 111 and the second speaker 112 may output a sound in a backward direction of the vehicle 10.

The first speaker 111 and the second speaker 112 may be configured to reproduce a sound source of a high frequency band corresponding to a virtual engine sound.

The sound output from the first speaker 111 and the sound output from the second speaker 112 may cancel each other (destructive interference), thus disappearing, or may be added together, leading to a higher amplitude.

To this end, in various embodiments, the first speaker 111 and the second speaker 112 may be installed on the same line with respect to at least two axes (e.g., the x-axis and the z-axis).

In addition, the first speaker 111 and the second speaker 112 may have the same size.

According to various embodiments, when the first speaker 111 outputs a first sound and the second speaker 112 outputs a second sound having an inverse phase of the first sound, the first sound output from the first speaker 111 and the second sound output from the second speaker 112 may cancel each other out, thus disappearing.

Conversely, when the first speaker 111 outputs a first sound and the second speaker 112 outputs a second sound having the same phase as the first sound, the first sound output from the first speaker 111 and the second sound output from the second speaker 112 may be added together (constructive interference), leading to a higher amplitude.

In one embodiment, the sound blocking module 120 includes a sound blocker 121, a hinge portion 122 configured to fix at least a portion of the sound blocker 121, and an actuator 123 configured to open and close the hinge portion 122.

The sound blocker 121 may be a screen or plate rotating through the hinge portion 122 to be converted into a state (hereinafter, referred to as 'first state') that blocks the front of the second speaker 112 or a state (hereinafter, referred to as 'second state') that opens the front of the second speaker 112. In this case, the front of the second speaker 112 may refer to a portion facing in an outward direction of the vehicle 10, that is, a direction in which sound is output from the second speaker 112.

For example, in one embodiment, when the VESS 110 is located on the front portion of the vehicle 10 and the second speaker 112 outputs a sound in a forward direction of the vehicle 10, the sound blocker 121 in the first state may be disposed forward of the second speaker 112 with respect to the vehicle 10.

In another embodiment, when the VESS 110 is located on the rear portion of the vehicle 10 and the second speaker 112 outputs a sound in a backward direction of the vehicle 10, the sound blocker 121 in the first state may be disposed backward of the second speaker 112 with respect to the vehicle 10.

In one embodiment, the sound blocker 121 may include a sound absorbing material disposed in the form of a wedge. Since the sound absorbing material provided in the form of a wedge may effectively block the sound, the sound blocker 121 formed of the sound absorbing material disposed in the form of a wedge may effectively block a sound output from the second speaker 112.

In an embodiment, the boundary of the sound blocker 121 may be formed of an elastic material (e.g., sponge, urethane, rubber, etc.). According to the embodiment, since the boundary of the 121 is formed of an elastic material, a sound output from the second speaker 112 is prevented from being refracted and radiated to the outside of the vehicle 10.

The actuator 123 may convert the sound blocker 121 into one of the first state or the second state by opening and closing the hinge portion 122 based on a driving signal.

In one embodiment, the actuator 123 may include a driving motor configured to generate a driving force for converting the sound blocker 121 to the first state or the second state and a driving circuit configured to supply a driving electricity to the driving motor according to a control signal of the controller 140.

The driving motor may be supplied with a driving electricity from the driving circuit and convert the supplied driving electricity into a rotational force. The driving motor may transmit the rotational force to the hinge portion 122 to open and close the hinge portion 122. In addition, the sound blocker 121 may be converted into the first state or the second state by the rotational force converted through the hinge portion 122.

For example, the rotational force generated by the driving motor may be transmitted to the sound blocker 121 through a gear or the like (e.g., the hinge portion 122). In other words, the driving motor may convert the sound blocker 121 into the first state or the second state through a gear or the like.

As another example, the rotational force generated by the driving motor may be transmitted to the sound blocker 121 through a fluid, a piston, or the like. In other words, the driving motor may convert the sound blocker 121 to the first state or to the second state through a piston or the like.

The driving circuit may supply the driving motor with a driving electricity for converting the sound blocker 121 to the first state or with a driving electricity for converting the sound blocker 121 to the second state according to a control signal of the controller 140. For example, the driving circuit may supply the driving motor with a positive driving current for converting the sound blocker 121 to the first state, and supply the driving motor with a negative driving current for converting the sound blocker 121 to the second state.

The driving circuit may include a switching element, such as a relay, for supplying the driving electricity to the driving motor or blocking the driving electricity, or may include an inverter circuit.

The speed sensor 130 may detect the traveling speed of the vehicle 10. According to various embodiments, the speed sensor 130 may include a wheel sensor that detects a wheel speed.

According to various embodiments, the controller 140 may control various components of the vehicle 10 based on data and/or information obtained through various communication methods.

In an embodiment, the controller 140 may obtain travelling speed information from the speed sensor 130 through a vehicle communication network (e.g., controller area network (CAN) communication), and based on the travelling speed of the vehicle 10, may control the VESS 110 and/or the sound blocking module 120 based on the travelling speed of the vehicle 10.

In one embodiment, the controller 140 may obtain various pieces of information (e.g., shift stage of a transmission lever) from various electronic control units of the vehicle 10 through a vehicle communication network (e.g., CAN communication), and control the VESS 110 based on various pieces of information obtained from the various electronic control units.

For example, the controller 140 may control the VESS 110 to output a virtual engine sound when the shift stage of the transmission lever is the 'D' stage and the travelling speed of the vehicle 10 is less than or equal to a preset speed.

As another example, the controller may control the sound blocking module 120 to be converted into the first state when the shift stage of the transmission lever is the 'D' stage and the vehicle 10 is in a stopped state.

To this end, the controller 140 may include at least one memory in which a program for performing the above-described operation and an operation to be described below is stored and at least one processor for executing the stored program. When the memory and the processor are each provided in plural, the plurality of memories and the plurality of processors may be integrated on a single chip or may be provided in physically separate locations.

The at least one memory may store sound source data corresponding to a virtual engine sound and sound source data corresponding to a preset sound.

The at least one processor may include a signal processing processor configured to process the sound source data stored in the at least one memory.

In addition, the controller 140 may include various electronic circuits (e.g., an analog-to-digital converter, a digital signal processor, a phase inverter, etc.) for processing the sound source data.

In the description above, various components of the vehicle 10 have been described, but the vehicle 10 according to the embodiment may not only include the above described components, but may also include various components that may be employable in a general technology and employable in the disclosure. Hereinafter, a method of controlling the vehicle 10 using the various components described above will be described.

Figure 4:
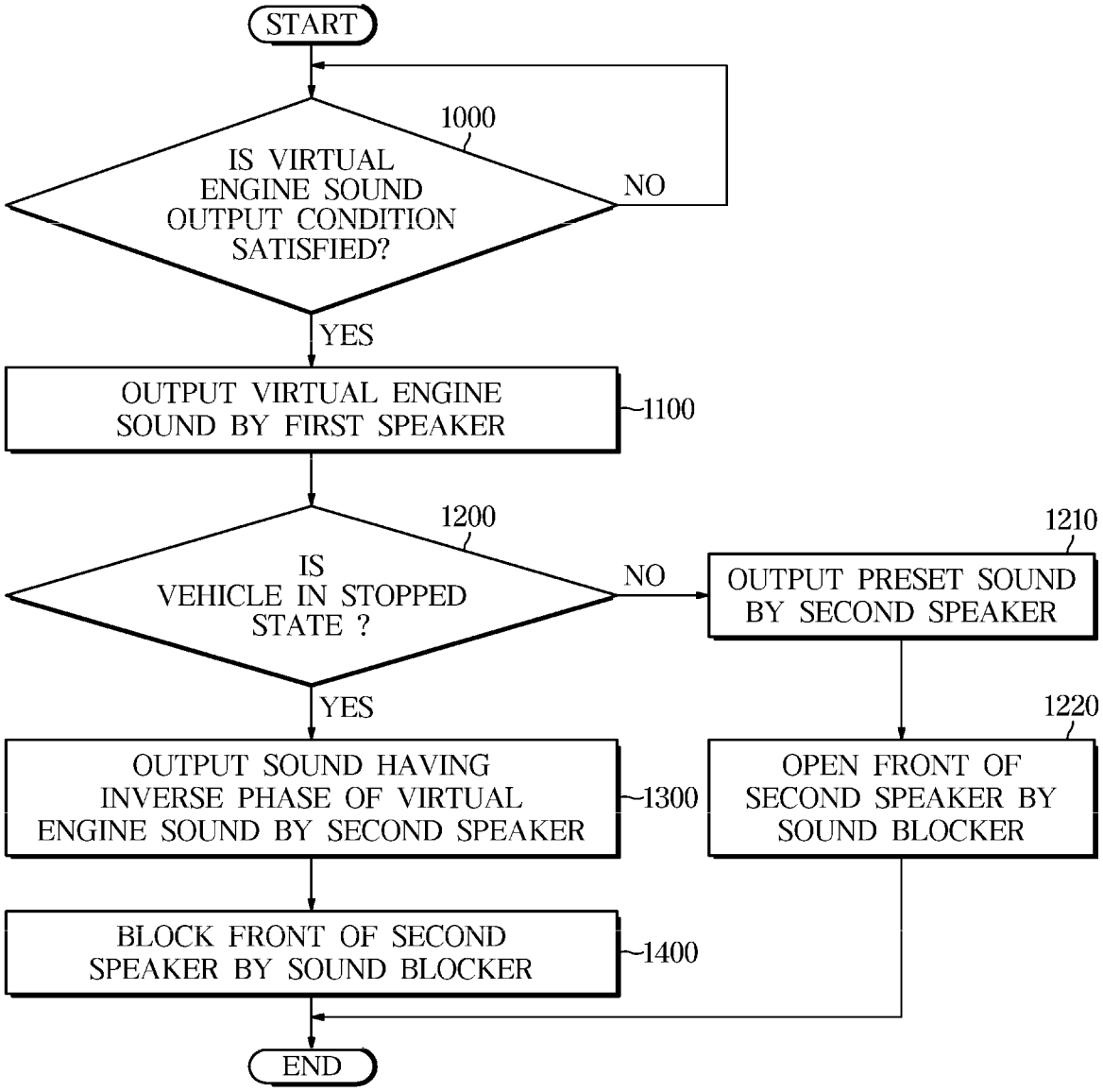
FIG. 4 is a flowchart showing a method for controlling a vehicle according to an embodiment.
Figure 5:
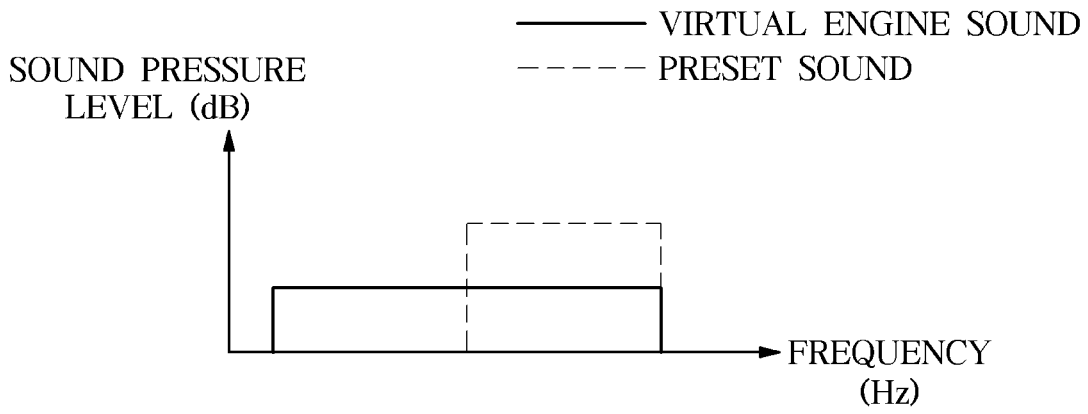
FIG. 5 is a diagram for describing characteristics of a sound output from a first speaker and a sound output from a second speaker of a vehicle according to an embodiment.
Figure 6:
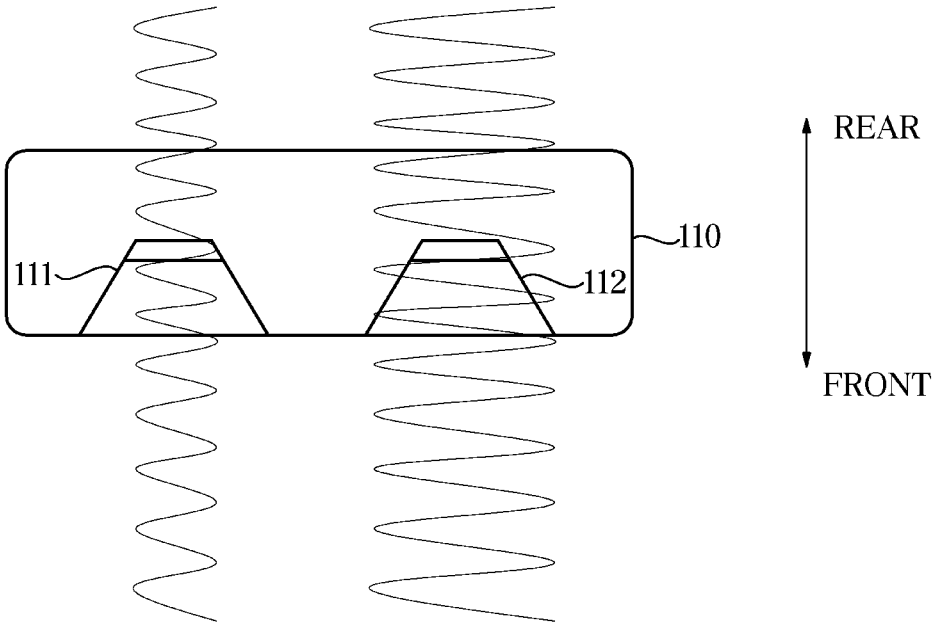
FIG. 6 is a diagram illustrating a sound output from a VESS when a vehicle according to an embodiment is not in a stopped state.
Figure 7:
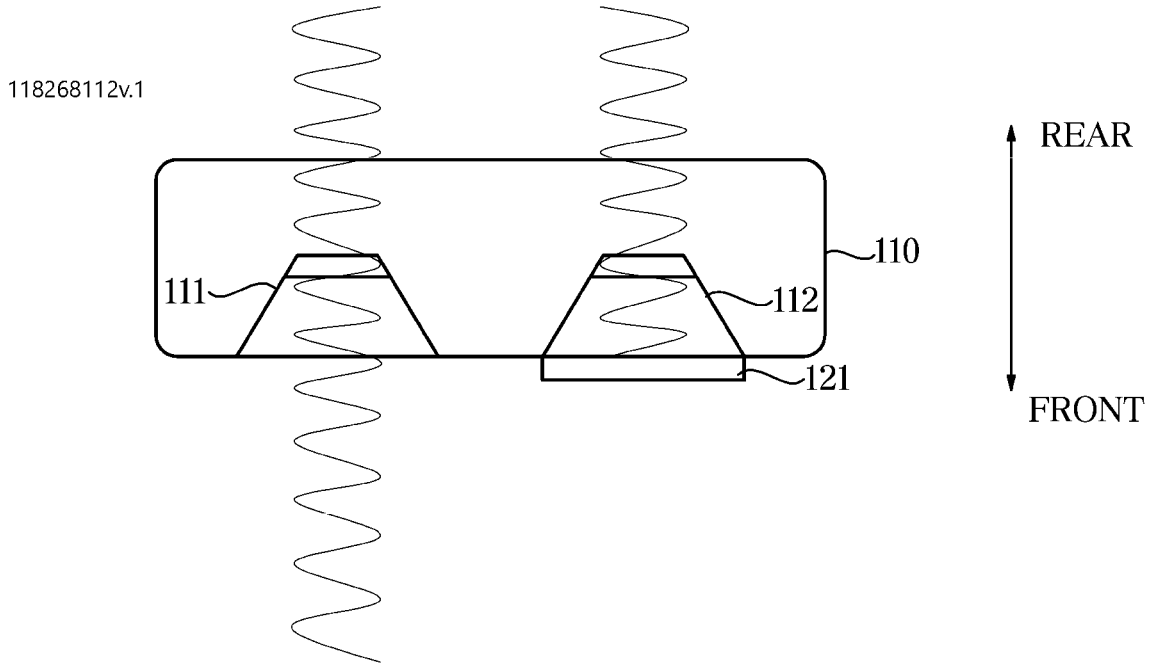
FIG. 7 is a diagram illustrating a sound output from a VESS when a vehicle according to an embodiment is in a stopped state.

FIG. 4 is a flowchart showing a method for controlling a vehicle according to an embodiment, FIG. 5 is a diagram for describing characteristics of a sound output from a first speaker and a sound output from a second speaker of a vehicle according to an embodiment, FIG. 6 is a diagram illustrating a sound output from a VESS when a vehicle according to an embodiment is not in a stopped state, and FIG. 7 is a diagram illustrating a sound output from a VESS when a vehicle according to an embodiment is in a stopped state.

Referring to FIG. 4, the controller 140, when a virtual engine sound output condition is satisfied (Yes in operation 1000), may control the first speaker 111 to output a virtual engine sound (1100).

The virtual engine sound output condition may include, for example, a case in which the shift stage of the transmission lever is the 'D' stage and the travelling speed of the vehicle 10 is less than or equal to a preset speed (e.g., 30 km/h).

When the virtual engine sound output condition is satisfied (Yes in operation 1000), the controller 140 may control the output of the second speaker 112 based on the state (e.g., stop or travel) of the vehicle 10.

According to an embodiment, the controller 140, when the travelling speed of the vehicle 10 is less than a stop threshold speed (e.g., 5 km/h), may determine that the vehicle 10 is in a stopped state, and when the travelling speed of the vehicle 10 is greater than or equal to the stop threshold speed, may determine that the vehicle 10 is in a travelling state.

When the vehicle 10 is not in a stopped state (NO in operation 1200), the controller 140 may control the VESS 110 so that the second speaker 112 outputs a preset sound (1210).

In this case, the sound source data corresponding to the preset sound may be stored in the memory, and the preset sound may have a frequency band narrower than that of the virtual engine sound output from the first speaker 111. For example, the preset sound may have a minimum frequency greater than that of the virtual engine sound, and have a maximum frequency greater than or equal to that of the virtual engine sound.

In addition, the preset sound may have a sound pressure level greater than that of the virtual engine sound.

Referring to FIG. 5, the virtual engine sound may have a first frequency band (e.g., 160 Hz to 5 kHz), and the preset sound may have a second frequency band (e.g., 1 kHz to 5 kHz).

In addition, the sound pressure level in the second frequency band of the preset sound may be greater than the sound pressure level in the first frequency band of the virtual engine sound.

According to various embodiments, the preset sound may be designed by a designer based on an isoacoustic curve.

Referring to FIG. 6, according to an embodiment, when the vehicle 10 is not in a stopped state (No in operation 1200), the controller 140 may control the sound blocking module 120 to convert the sound blocker 121 into the second state (1220).

When the sound blocker 121 is converted into the second state, the sound output from the second speaker 112 may be radiated to the outside (e.g., the front of FIG. 6) of the vehicle 10.

When the first speaker 111 outputs the virtual engine sound and the second speaker 112 outputs the preset sound, the virtual engine sound and the preset sound may be added together, leading to a higher amplitude.

Specifically, the preset sound may reinforce the amplitude in a high-frequency band (e.g., 1 kHz to 5 kHz) of the virtual engine sound, so that pedestrians around the vehicle 10 may easily recognize the vehicle 10.

According to the present embodiment, by reinforcing the virtual engine sound of the high frequency band, the awareness of pedestrians around the vehicle 10 may be maximized so that a safety accident may be prevented in advance.

Referring again to FIG. 5, when the vehicle 10 is in a stopped state (YES in operation 1200), the second speaker 112 may control the VESS 110 such that the second speaker 112 outputs a sound that has an inverse phase of the virtual engine sound output from the first speaker 111 (1300).

For example, when the vehicle 10 is in a stopped state, the controller 140 may apply a sound source signal of a virtual engine sound to the first speaker 111, and apply the sound source signal of the virtual engine sound to the second speaker 112 through a phase inverter.

Referring to FIG. 7, according to an embodiment, when the vehicle 10 is in a stopped state (Yes in operation 1200), the controller 140 may control the sound blocking module 120 to convert the sound blocker 121 into the first state (1400).

When the sound blocker 121 is converted into the first state, the sound output from the second speaker 112 is prevented from being radiated to the outside (e.g., the front of FIG. 7) of the vehicle 10.

The first speaker 111 may output the virtual engine sound toward the outside (e.g., the front of FIG. 7), but because the virtual engine sound includes a low frequency with a relatively long wavelength, part of the virtual engine sound may be introduced to the inside of the vehicle 10.

When the vehicle 10 is in a stopped, the part of the virtual engine sound introduced into the vehicle 10 in a quiet state may cause discomfort to the occupant.

According to the present embodiment, the first speaker 111 outputs a virtual engine sound, and the second speaker 112 outputs a sound having an inverse phase of the virtual engine sound, so that the sound waves directed to the inside (e.g., the rear in FIG. 7) of the vehicle 10 may cancel each other out and disappear. Accordingly, according to the embodiment, the virtual engine sound introduced into the inside of the vehicle 10 disappears, and the occupant's discomfort may be relieved.

On the other hand, because the inverse-phase sound output from the second speaker 112 is blocked by the sound blocker 121 without being radiated to the front of the vehicle 10, so that the virtual engine sound output from the first speaker 111 and directed to the front of the vehicle 10 may be transmitted to pedestrians.

In other words, according to the embodiment, the occupant inside the vehicle 10 in a stopped state may not recognize the virtual engine sound, and the pedestrian outside the vehicle 10 in a stopped state may recognize the virtual engine sound.

According to the various embodiments of the present disclosure, the vehicle 10 and the method of controlling the vehicle 10 may, in a travelling state, provide pedestrians with an improved perception of a virtual engine sound and in a stopped state, block an unpleasant sound transmitted to occupants by constructing the VESS 110 using at least two speakers.

Meanwhile, the disclosed embodiments may be embodied in the form of a recording medium storing instructions executable by a computer. The instructions may be stored in the form of program code and, when executed by a processor, may generate a program module to perform the operations of the disclosed embodiments. The recording medium may be embodied as a computer-readable recording medium.

The computer-readable recording medium includes all kinds of recording media in which instructions which may be decoded by a computer are stored, for example, a Read Only Memory (ROM), a Random Access Memory (RAM), a magnetic tape, a magnetic disk, a flash memory, an optical data storage device, and the like.

As is apparent from the above, the vehicle and the method of controlling the same according to the embodiment can block the virtual engine sound introduced into the vehicle, thereby reducing discomfort of occupants.

According to the vehicle and the method of controlling the same according to the embodiment can output a sound capable of maximizing the perception of a pedestrian together with a virtual engine sound, thereby preventing a pedestrian accident in advance.

Although embodiments of the present disclosure have been described for illustrative purposes, those skilled in the art will appreciate that various modifications, additions and substitutions are possible, without departing from the scope and spirit of the disclosure. Therefore, embodiments of the present disclosure have not been described for limiting purposes.

What is claimed is:

1. A vehicle, comprising:

a speed sensor configured to detect a travelling speed of the vehicle;

a virtual engine sound system (VESS) including a first speaker and a second speaker; and a controller configured to control the VESS based on the travelling speed, wherein the controller is configured to:

upon the vehicle being in a stopped state, control the VESS such that the first speaker outputs a virtual engine sound and the second speaker outputs a sound having an inverse phase of the virtual engine sound.

2. The vehicle of claim 1, wherein the controller is configured to, upon the vehicle not being in the stopped state, control the VESS such that the second speaker outputs a preset sound.

3. The vehicle of claim 2, wherein the preset sound has a frequency band narrower than a frequency band of the virtual engine sound, and a sound pressure level greater than a sound pressure level of the virtual engine sound.

4. The vehicle of claim 2, wherein the preset sound has a minimum frequency greater than a minimum frequency of the virtual engine sound.

5. The vehicle of claim 1, further comprising a sound blocker configured to be converted into a first state that blocks a front side of the second speaker or a second state that opens the front side of the second speaker, and an actuator configured to convert the sound blocker into one of the first state and the second state, wherein the controller is configured to control the actuator to convert the sound blocker into the first state upon the vehicle being in the stopped state, and convert the sound blocker into the second state upon the vehicle not being in the stopped state.

6. The vehicle of claim 5, wherein the sound blocker is provided to be rotatable through a hinge portion, and the actuator includes a driving motor configured to apply a rotational force to the hinge portion.

7. The vehicle of claim 5, wherein a boundary portion of the sound blocker is composed of an elastic material.

8. The vehicle of claim 5, wherein the sound blocker includes a sound absorbing material disposed in a form of a wedge.

9. The vehicle of claim 1, wherein the first speaker and the second speaker are installed on a same line with respect to at least two axes.

10. The vehicle of claim 1, wherein the first speaker and the second speaker are the same size.

11. A method of controlling a vehicle including a virtual engine sound system (VESS), the method comprising:

outputting, by a first speaker of the VESS, a virtual engine sound upon a virtual engine sound output condition being satisfied; and outputting, by a second speaker of the VESS, a sound having an inverse phase of the virtual engine sound upon the vehicle being in a stopped state.

12. The method of claim 11, further comprising outputting, by the second speaker, a preset sound upon the vehicle not being in the stopped state.

13. The method of claim 12, wherein the preset sound has a frequency band narrower than a frequency band of the virtual engine sound, and a sound pressure level greater than a sound pressure level of the virtual engine sound.

14. The method of claim 12, wherein the preset sound has a minimum frequency greater than a minimum frequency of the virtual engine sound.

15. The method of claim 11, wherein the vehicle includes a sound blocker configured to be converted into a first state that blocks a front side of the second speaker or a second state that opens the front side of the second speaker, and the method further comprises:

converting the sound blocker into the first state upon the vehicle being in the stopped state, and converting the sound blocker into the second state upon the vehicle not being in the stopped state.

16. The method of claim 15, wherein the sound blocker is provided to be rotatable through a hinge portion, and wherein the converting of the sound blocker into the first state or the second state includes applying a driving current to a driving motor configured to apply a rotational force to the hinge portion.

17. The method of claim 15, wherein a boundary portion of the sound blocker is composed of an elastic material.

18. The method of claim 15, wherein the sound blocker includes a sound absorbing material disposed in a form of a wedge.

19. The method of claim 11, wherein the first speaker and the second speaker are installed on a same line with respect to at least two axes.

20. The method of claim 11, wherein the first speaker and the second speaker are the same size.

* * * * *